US006257511B1

(12) United States Patent
Turner

(10) Patent No.: US 6,257,511 B1
(45) **Date of Patent: *Jul. 10, 2001**

(54) WOOD-CHIPPING MACHINES

(76) Inventor: Anthony L. Turner, The Mill House, King's Coughton, Alcester, Warwickshire, B59 50G (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/398,644

(22) Filed: Sep. 17, 1999

Related U.S. Application Data

(63) Continuation-in-part of application No. 08/912,085, filed on Aug. 15, 1997, now Pat. No. 5,961,057.

(51) Int. Cl.[7] ..... B02C 18/06
(52) U.S. Cl. ..... 241/92; 241/296
(58) Field of Search ..... 241/92, 296

(56) References Cited

U.S. PATENT DOCUMENTS 4,463,907 * 8/1984 Biersack ..... 241/92
5,961,057 * 10/1999 Turner ..... 241/92

* cited by examiner

*Primary Examiner*—Mark Rosenbaum
(74) *Attorney, Agent, or Firm*—Marshall & Melhorn, LLC

(57) ABSTRACT

A wood-chipping machine has a plurality of cutters carried by a flywheel which is rotated to move the cutters across a throat through which material to be chipped is fed, and in which each cutter is substantially frusto-conical and hence circular and a plurality of such cutters form a blade at a generally radial location of the flywheel. These facilitate blade replacement in the event of wear, e.g., by adjusting the worn cutter angularly.

13 Claims, 6 Drawing Sheets

130
134
136
138
140
143
150
152
132
ø4L
R66
R30
R120
R50
R66
R16
R48
R50
R198
R200
91
95
90°

2.5°
234
236
243
α

WOOD-CHIPPING MACHINES

This application is a continuation-in-part of U.S. Ser. No. 08/912,085, filed Aug. 15, 1997, now U.S. Pat. No. 5,961,057.

BACKGROUND OF THE INVENTION

This invention relates to machines for making chips from brushwood and the like. These are used by tree surgeons, contractors, and public authorities, to clear waste timber and turn it into a particulate material useful for mulching, compost production, and possibly as a material for making wood-based products such as chip-board.

The industry standard machine has a feed roller or rollers provided with teeth to grip and embed in the branches, small diameter logs, twigs and the like, and feed these through a throat to meet a flywheel generally at a radial position relative to its center. The flywheel is massive because of the requirements, and carries cutter blades on one face at a plurality of radial locations, typically three, each of which is a straight blade which has its cutting edge extending parallel to an individual radius of the flywheel and of a length corresponding to a particular dimension of the throat. One edge of the throat provides a second cutting edge. As each blade moves over the throat and across the second cutting edge, the end of the fed material, which projects beyond that edge, is impacted by the blade and chopped off Because of the nature of the material with a grain structure, a large area, as of a log, is fractured into a large number of chips. Small cross-sectional areas such as twigs may form only a single chip with each cutting stroke.

The flywheel may rotate at a high speed on the order of hundreds or thousands of RPM, and there is considerable noise from the cutters operation as well as from the driving source. The blade life is relatively short between each re-sharpening operation or replacement, due to ordinary wear and tear, and to foreign bodies which tend to be fed in, e.g., stones or grit. In ordinary operations, a chipper run more-or-less continuously during working shifts may need sharpening every 15–30 hours, and can be re-sharpened a limited number of times.

The object of the invention is to provide improvements, particularly in shortening down-time when sharpening is called for, in reducing cost of re-sharpening, and in reducing the cost of replacement blades. Supplementary objects include reducing noise and power requirements.

SUMMARY OF THE INVENTION

According to the invention, a chip-making machine has blades at a plurality of generally radial positions on a flywheel, and is characterized by each blade consisting of one or more individual cutters arranged so as to be angularly adjustable whereby different positions of the periphery of each cutter may be successively moved into operative position.

Preferably a series of circular cutters is arranged along a line containing the axis of all of the plurality, possibly, but not essentially, with all of the cutters in point-to-point contact one with the next. However, square or other polygonal cutters could be used in similar manner, preferably adjusted so that their combined operative edges do not form a straight line.

The present inventor has discovered that the industry standard machine has the effect of displacing the fed material laterally of the throat in the direction from the center of the disc to the periphery. This results in increased wear at the outer end of each of the straight-edge cutter blades used in this prior art, and perhaps increased power requirement because of less favorable mechanical advantage.

In contrast, the invention may use blades having their axes distributed along the length of an arc (i.e., the line containing the axes is not straight), which may include the flywheel center, but which has the effect of displacing the fed material inwardly towards the axis of the flywheel. This important feature of the invention is believed to result in reduced power requirements because of improved mechanical advantage. An experimental machine according to the invention is substantially less noisy than existing prior art machines, possibly due to the same feature.

A saving in blade sharpening is possible, using a plurality of cutters to correspond to each of the straight cutter blades in the prior art, because the cutter nearest the flywheel axis which performs most of the cutting, due to the feature explained above, can be re-sharpened, or if necessary, replaced without it being necessary to replace or resharpen the others. The same effect was not true in the prior art because the single blade had to be removed, and because sharpening had to be done in a jig, the whole of the length of the cutting edge had to be treated even if damage was limited to one end section.

However, it is preferred to arrange circular cutters so that each has a minor portion of its periphery exposed for cutting. Using three circular cutters in each group, i.e., to constitute the equivalent of each single straight cutter blade in the prior art (although not, or not necessarily having their axes on a straight line) effectively 120 degrees of each circular cutter may be effective. Hence, each cutter has three portions which can be used in turn, before any re-sharpening is necessary.

The cutters may each be made integral with a large diameter hub, received in a corresponding mounting socket on the flywheel, so that stresses are taken by the hub/socket engagement. Each blade may be held in position by a corresponding bolt. When blade edge replacement is necessary, the cutters may be loosened, and turned angularly to present a fresh portion of the cutting edge for use; it will be appreciated that re-sharpening is only necessary after the whole periphery has become worn. Moreover, if one cutter wears more rapidly, it may be adjusted or replaced without having to adjust or replace the unworn ones. It is believed that this feature will substantially reduce down-time, and sharpening and blade replacement costs.

Another aspect of the use of a plurality of circular cutting blades, which together form a group for moving as one over the throat of the machine, is that they combine to provide an edge which may be sinuous, instead of a straight line, and moreover which can be effectively continuous (if the discs touch each other), or discontinuous (if spaced further apart), and it is thought that these factors contribute to produce a slicing action rather than a chopping action; this has some effect on power requirement, noise, and perhaps also on blade wear.

The machine according to the present invention may be conventional in all respects except that of using the novel cutter blade arrangement.

BRIEF DESCRIPTION OF THE DRAWINGS

One presently preferred embodiment of the invention is now more particularly described with reference to the accompanying drawings wherein.

DESCRIPTION OF THE PREFERRED DRAWINGS

Figure 1:
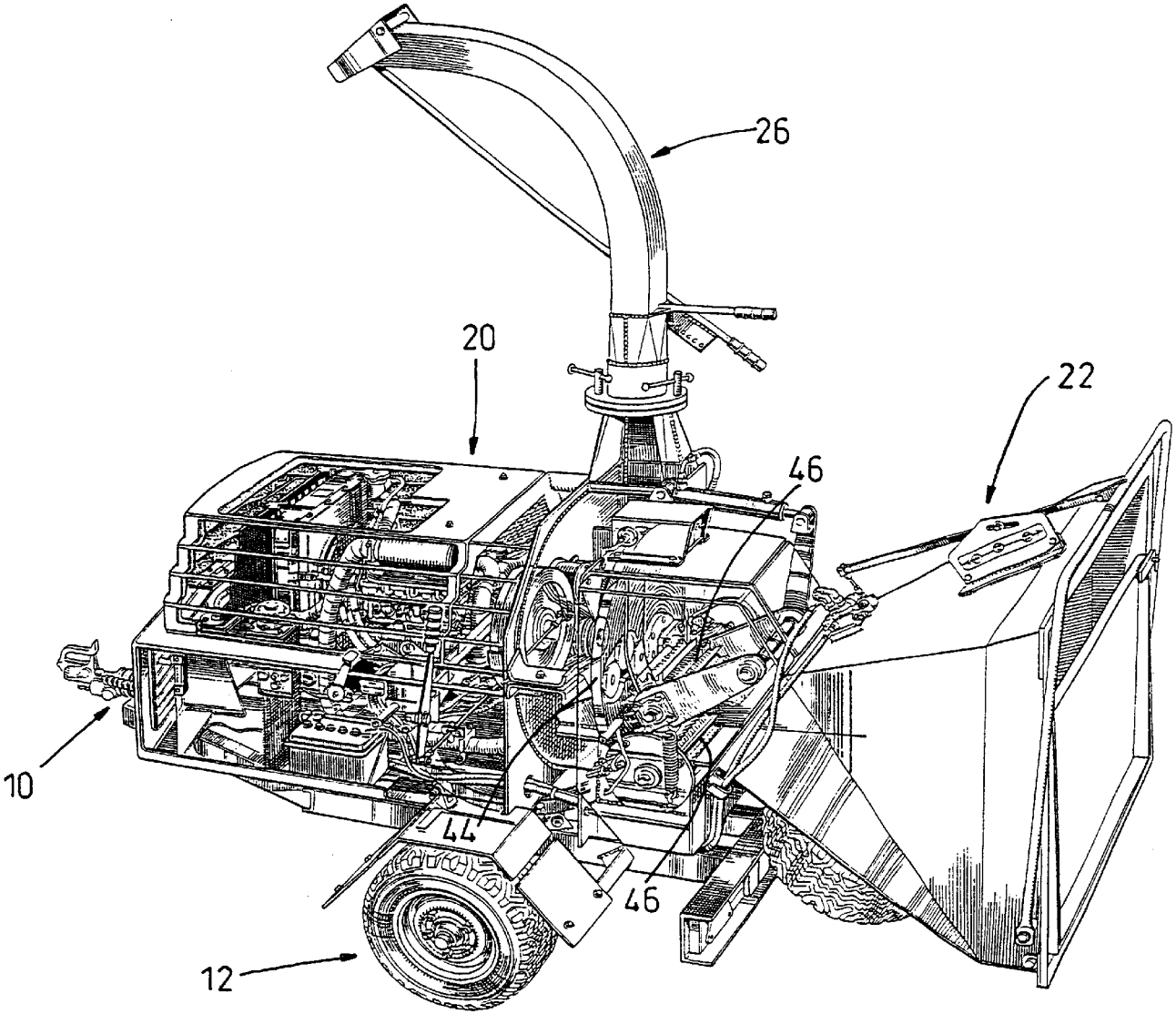
FIG. 1 is a somewhat diagrammatic and cutaway perspective illustration of a combined machine for chipping and shredding.
Figure 3:
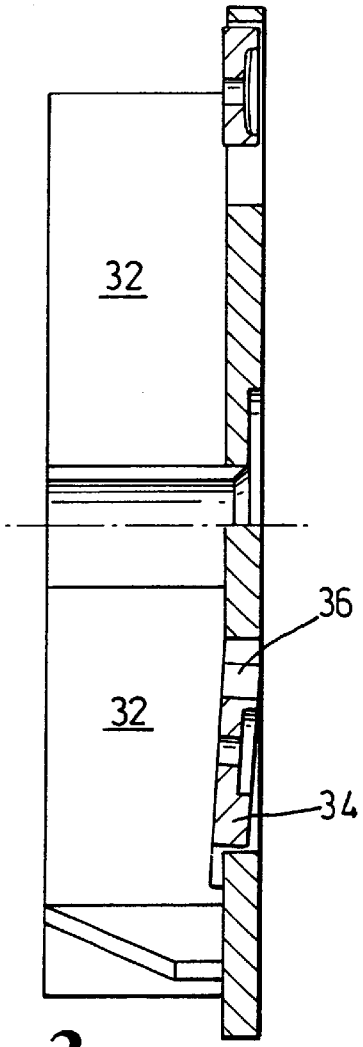
FIG. 3 is a side view of the disc shown in FIG. 2.

Turning first to FIG. 1, the machine may be portable, that is to say generally arranged as a trailer to be towed by a motor vehicle by means of a towing hitch 10 and supported by a pair of wheels 12.

The trailer supports an engine 20 with associated fuel tank coolant reservoir and like accessories. The engine drives a main shaft not clearly seen in FIG. 1.

The machine has a supply hopper 22, for material to be chipped. Chipped material is to be delivered through the outlet pipe 26 which can be swivelled to an appropriate angle according to the location of a skip or other receptacle for the chips.

Figure 2:
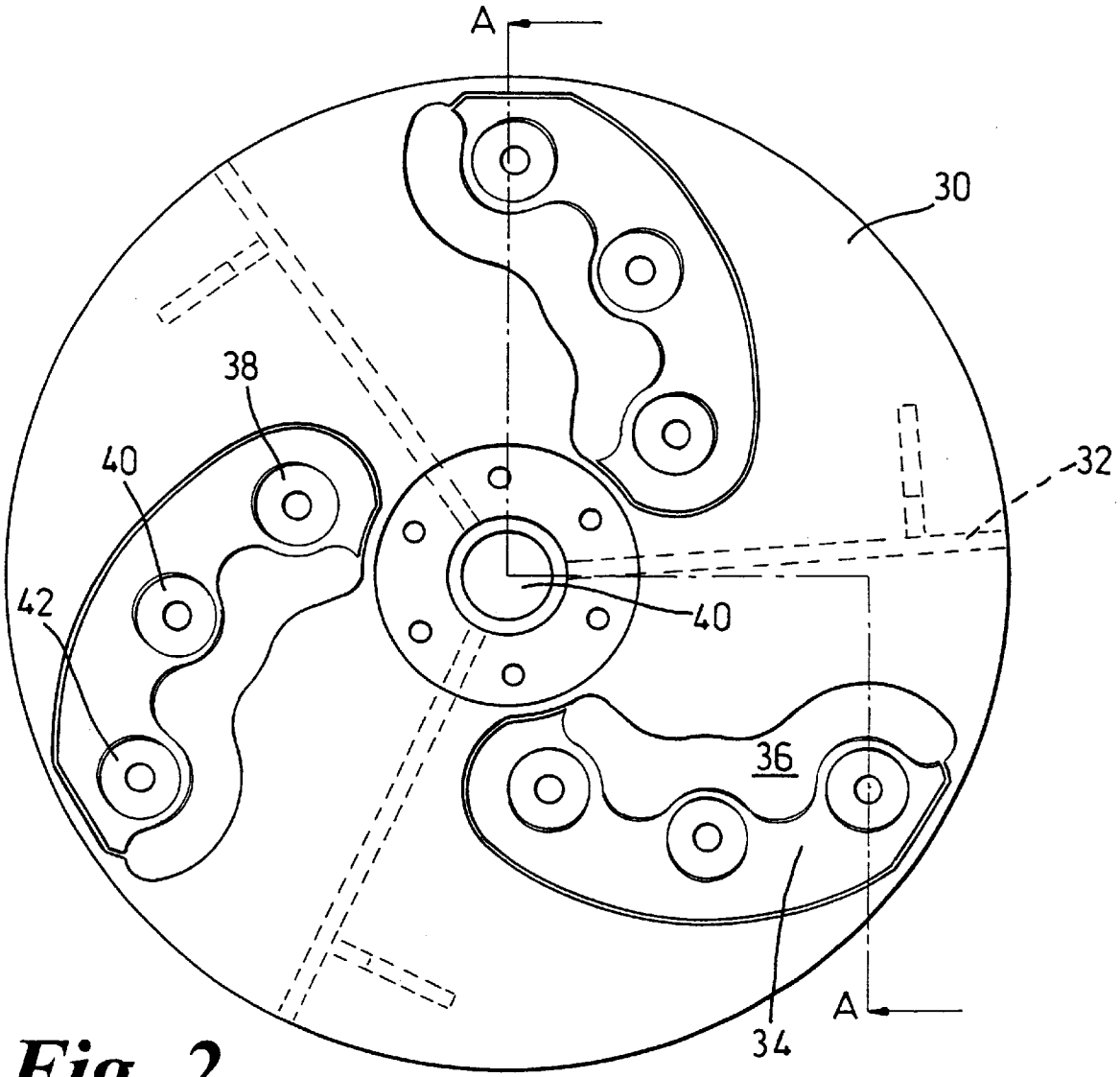
FIG. 2 is an elevation of the cutting disk used in the machine of FIG. 1, on an enlarged scale.

Turning next to FIG. 2, the flywheel 30 is made of thick steel plate and reinforced by a number of radially extended webs 32 which have the additional function of providing an air draft for carrying chipped material through the casing of the machine and through the delivery tube 26.

The flywheel is, in this embodiment, provided with the sets of cutters which are equispaced in the interests of balance of the rotating mass afforded by the flywheel 30 and the cutters. Each set comprises a carrier pad 34 which may be, for example, welded to the flywheel 30 about its periphery, and located closely adjacent to a correspondence aperture 36 in the flywheel. In this instance, three cutters 38, 40, 42 are provided in each set, the cutters being supported on the corresponding pad by bolts (not shown) extending through the pad and locked in place with the corresponding nuts.

Figure 4:
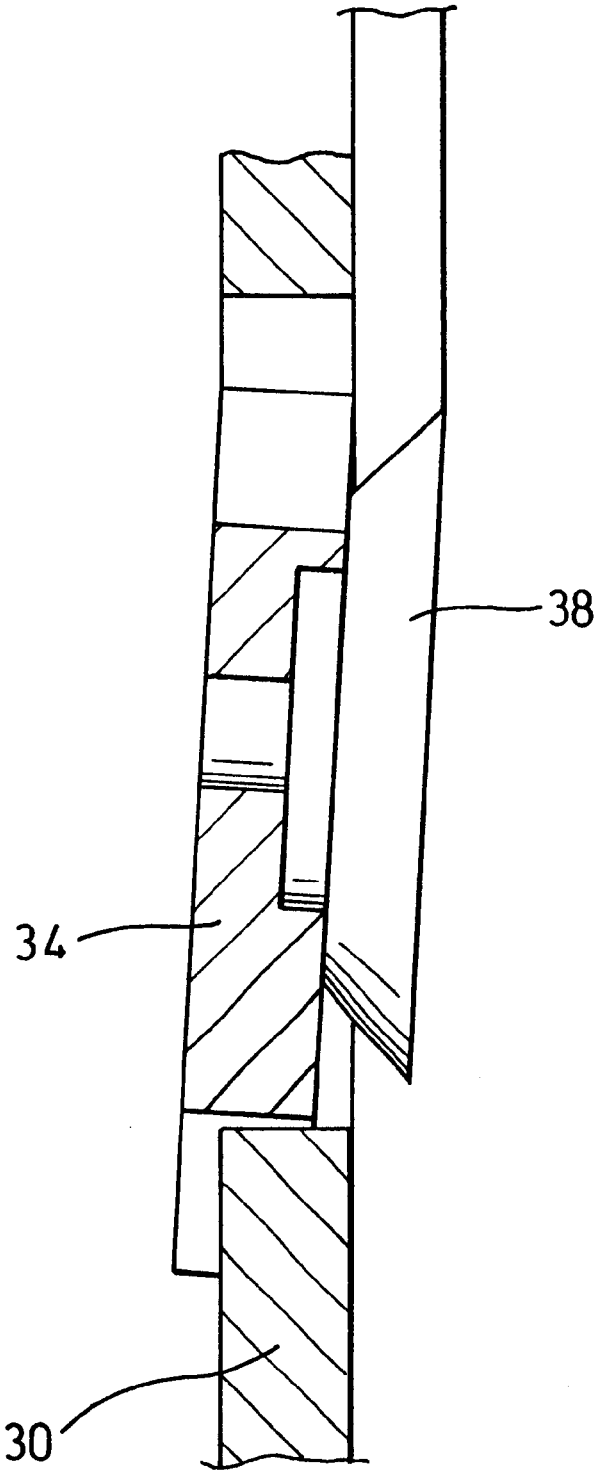
FIG. 4 is an enlarged scale sectional view showing one cutter.

Each cutter in this embodiment is frusto-conical in shape with the larger diameter of the frusto-cone lying in a plane approximately parallel to the face of the pad and forming a cutting edge. However, the pad is preferably inclined to a radius of the flywheel at a small angle, typically 3 degrees, as shown in FIG. 4.

The flywheel 30 is supported on drive shaft 43 for rotation so as to take the cutters in turn past a throat (aperture) in a stationary plate 44 which is generally parallel to the plane of the flywheel forming part of the housing in which the flywheel rotates.

A pair of spiked or similar drive rollers 46 (FIG. 1) are used to feed brushwood so that it passes through the throat and is impacted by the cutters to form chips, which are carried by the draft of air, created by the rotating vanes 32, out of the machine.

Figure 5:
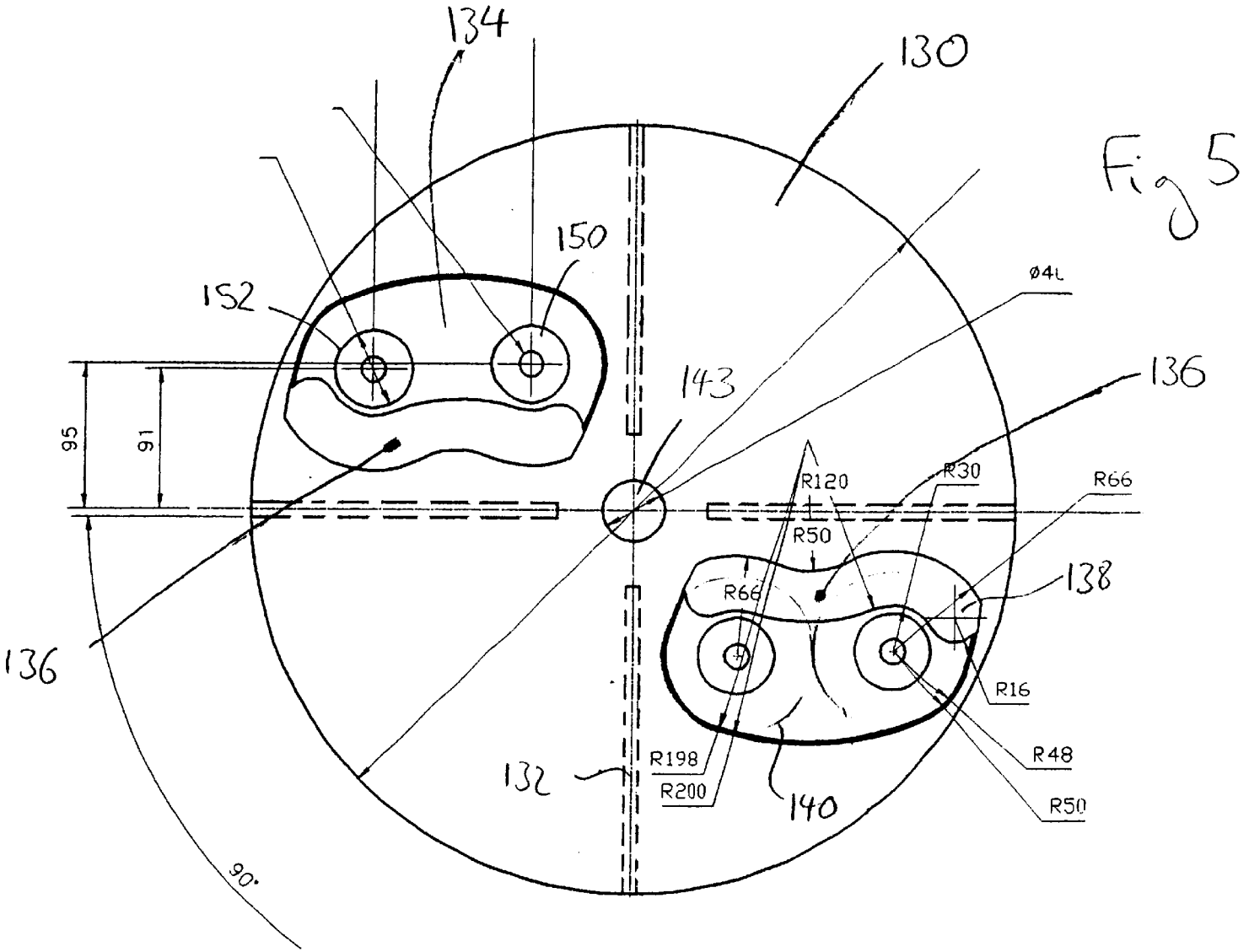
FIG. 5 is a front elevation of a second embodiment of a cutting disc machine shown in FIG. 1.

Referring to FIG. 5 there is shown a second embodiment of a cutting disc 130 according to the invention wherein components common with the earlier embodiments are given the same two-digit reference number prefixed with the numeral 1.

Accordingly, flywheel cutting disc 130 comprises webs 132 and a pair of pads 134, each for carrying a pair of cutters 138 and 140, as shown in the assembly at the bottom right-hand corner of FIG. 5. The pad 134 in the upper left-hand corner of the disc 130 shown in FIG. 5 comprises a pair of sockets 150 and 152 each for receiving an individual cutter for attachment as described earlier, for example, using a nut and bolt arrangement.

The cutting disc 130 shown in FIG. 5 is operably rotated in a counter-clockwise direction as viewed. Accordingly, the leading edge of a blade comprising individual cutters 138 and 140 is provided by the edge of the cutters foremost in a counter-clockwise direction. The leading edge of a blade is operably located proximate an aperture 136. The aperture or slot 136 comprises a leading and trailing edge in cutting disc 130. In this embodiment, the leading edge of the aperture 136 is curved and parallel in substantial parts to the leading edge of the blade. Similarly, the trailing edge of the aperture 136 is curved and parallel in part with the leading edge of the blade but located rearwardly off said leading edge of the blade.

Preferably the pads 124 are inclined with respect to the surface of the cutting disc 130 in a manner similar to that shown in FIG. 4 of the first embodiment. Although two blades are shown here, it is envisaged that any number, such as three or four, can be used on a cutting disc 130 wherein each blade consists of two or more individual cutters.

Figure 6:
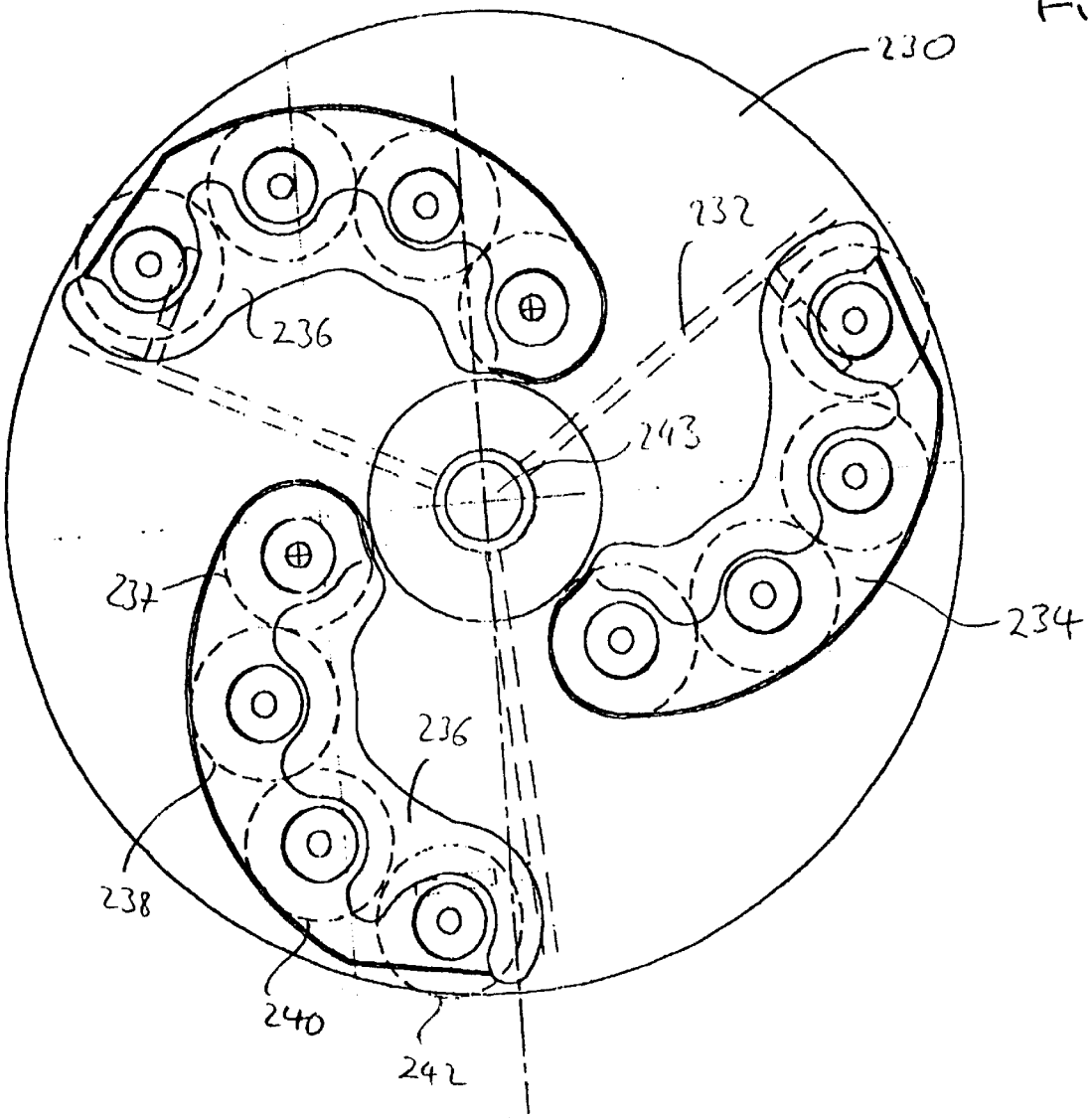
FIG. 6 is a schematic front elevation of a third embodiment of a cutting disc of a machine shown in FIG. 1.
Figure 7:
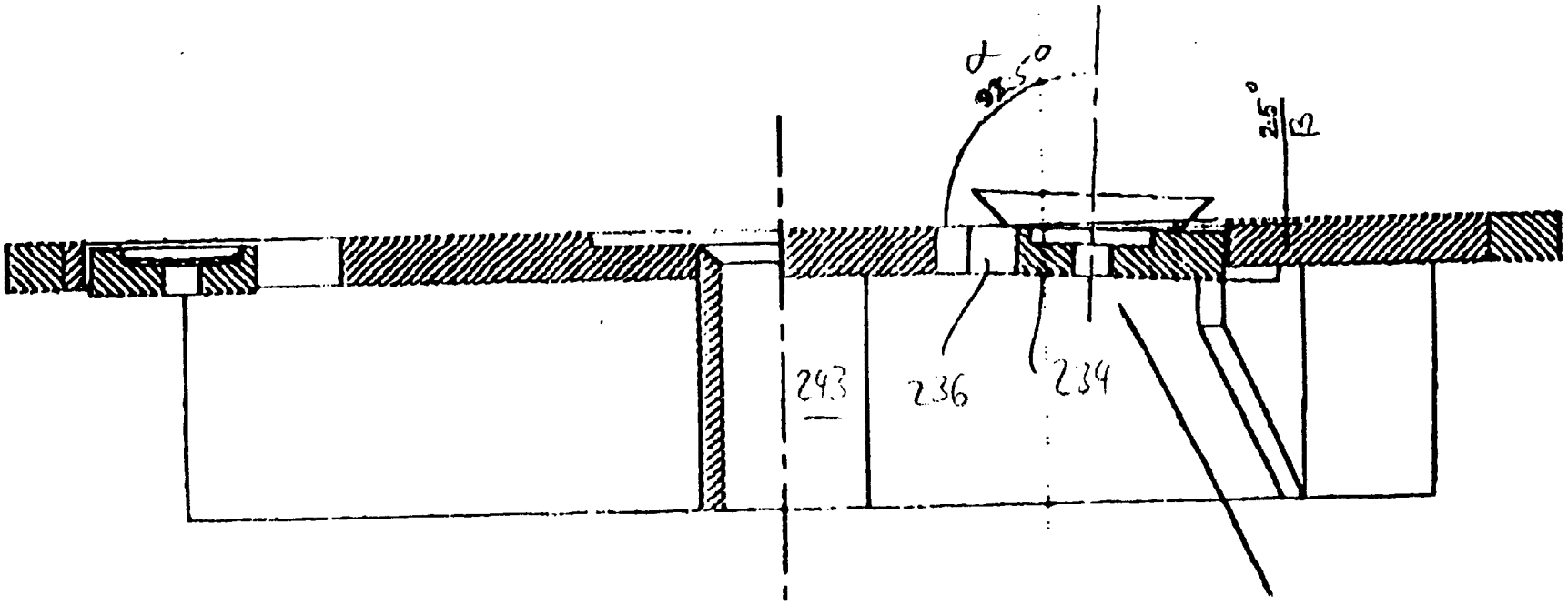
FIG. 7 is a schematic sectional side elevation view of the cutting disc shown in FIG. 6.

Referring to FIGS. 6 and 7 there is shown a further embodiment of a cutting disc according to the invention wherein cutting disc 230 is substantially similar to the earlier embodiments and like components are given the same two-digit reference number prefixed with the numeral 2. Accordingly, cutting disc 230 comprises webs 232 and pads 234 for carrying cutting blades. In this case three pads 234 are provided, each adapted to carry four cutters 237, 238, 240 and 242. Cutting disc 230 further comprises an aperture 236 proximate each of the blades.

Again in this embodiment, cutting disc 230 operably rotates in a counter-clockwise direction as viewed.

Accordingly, the blade comprises a leading cutting edge defined by parts of the four cutters in which cutters are positioned on pad 234 along a continuous curved line which passes through the center axis of each of the cutters. The aperture 236 for each blade is defined within the disc 230 proximate the leading edge of each of the blades. The leading edge of each of the apertures 236 comprises a substantially continuous curved edge which in part, at least, is parallel with the curved line passing through the central axes of the cutters. The trailing edge of the aperture 236, however, is substantially more curvy or arcuate similar to the embodiments shown in FIGS. 2 and 5, whereby the trailing edge is in substantial part parallel with part of the leading edge of the associated blade. Beneficially, objects which are cut by the blade are thereby directed by the cutters into the aperture 236 in a location rearward of the leading cutting edge of the blade.

Referring to FIG. 7, it can be seen that each pad 234 is inclined downwardly away from the upper surface of disc 230. In this case, the angle of the upper surface of the pad with respect to the upper surface of the disc 230 is Beta=2.5 degrees. Accordingly, the vertical axis passing through an individual cutter is Alpa=92.5 degrees. As can be seen, in the preferred form, the pad 234 inclines downwardly away from the aperture 236 thereby to provide a slightly raised leading edge of the blade.

It is apparent that the term cutting disc and flywheel are used interchangeably herein.

What is claimed is:

1. A chip-making machine having blades at a plurality of generally radial positions on a cutting disc, each blade including at least two circular cutters, so as to be angularly adjustable, whereby different portions of the periphery of each cutter may be successively moved into operation position, and wherein a series of two or more of said circular cutters is arranged along a line, all of the cutters in the series being in point-to-point contact one with the next, at least two cutters being arranged so that their axes lie on an arcuate line containing the center of the cutting disc.

2. A machine as claimed in claim 1 wherein each cutter is substantially frusto-conical with the larger diameter of the frusto-cone forming the cutting edge.

3. A machine according to claim 1 wherein each blade is mounted on a pad attached to the cutting disc.

4. A machine according to claim 3 wherein the cutting disc defines a first plane and the pad is inclined with respect to said first plane.

5. A machine according to claim 4 wherein the pad is inclined downwardly with respect to the first plane.

6. A machine according to claim 4 wherein the angle of inclination of the pad with respect to the first plane is on the order of 1–5 degrees.

7. A machine according to claim 5 wherein each blade comprises a leading edge and the cutting disc comprises an aperture proximate the leading edge of each blade, and wherein the pad inclines downwardly away from the aperture.

8. A machine according to claim 1 wherein each blade comprises a leading edge and the cutting disc comprises an aperture proximate the leading edge of each blade.

9. A machine according to claim 8 wherein the aperture is defined by a rim in the cutting disc and the rim comprises a leading and trailing edge, wherein the leading edge comprises a substantially constant curved portion which portion substantially follows the arcuate line through the axes of the at least two cutters.

10. A machine according to claim 8 wherein the trailing edge of the aperture comprises arcuate portions which are substantially parallel with part of the leading edge of the blade as defined by parts of the at least two cutters.

11. A machine according to claim 1 comprising two blades each having two cutters.

12. A machine according to claim 1 comprising three blades each having three cutters.

13. A machine according to claim 1 comprising three blades each having four cutters.

* * * * *